US005151071A

United States Patent [19]

Jain et al.

[11] Patent Number: 5,151,071

[45] Date of Patent: Sep. 29, 1992

[54] ISOINERTIAL LIFTING DEVICE

[75] Inventors: Sanjeev Jain, Columbia; John E. Vermette, Baltimore, both of Md.

[73] Assignee: Baltimore Therapeutic Equipment Co., Hanover, Md.

[21] Appl. No.: 593,886

[22] Filed: Oct. 5, 1990

[51] Int. Cl.[5] ..... A63B 21/062

[52] U.S. Cl. ..... 482/101; 482/102; 482/99; 482/8; 482/5; 482/115; 482/118; 482/120

[58] Field of Search ..... 272/117, 118, 116, 128, 272/129, 130, 132, 133, 134

[56] References Cited

U.S. PATENT DOCUMENTS

| | | | |
|---|---|---|---|
| 373,942 | 11/1887 | Page . | |
| 3,350,449 | 12/1970 | Henson . | |
| 3,397,884 | 8/1968 | Blasi . | |
| 3,589,193 | 6/1971 | Thornton . | |
| 3,851,874 | 12/1974 | Wilkin . | |
| 3,929,331 | 12/1975 | Beeding . | |
| 4,082,267 | 4/1978 | Flavell . | |
| 4,235,439 | 11/1980 | DeDonno . | |
| 4,475,408 | 10/1984 | Browning . | |
| 4,565,368 | 1/1986 | Boettcher . | |
| 4,592,545 | 6/1986 | Sagedahl . | |
| 4,603,885 | 8/1986 | Sebelle | 272/117 |
| 4,620,703 | 11/1986 | Greenhut | 272/129 |
| 4,666,151 | 5/1987 | Chillier | 272/134 |
| 4,678,184 | 7/1987 | Neiger et al. . | |
| 4,709,919 | 12/1987 | Cano | 272/128 X |
| 4,728,102 | 3/1988 | Pauls . | |
| 4,750,738 | 6/1988 | Dang | 272/129 X |
| 4,765,613 | 8/1988 | Voris | 272/134 X |
| 4,822,037 | 4/1989 | Makansi et al. | 272/129 |
| 4,826,154 | 5/1989 | Askonen | 272/118 |
| 4,882,677 | 11/1989 | Curran . | |
| 4,907,797 | 3/1990 | Gezari et al. | 272/118 X |

*Primary Examiner*—Richard J. Apley
*Assistant Examiner*—D. F. Crosby
*Attorney, Agent, or Firm*—James J. Brown

[57] ABSTRACT

An isoinertial lift machine is described which can be used to evaluate and train patients in the static and dynamic lift modes. The machine consists of an arm which can be positioned on a vertical column. At the end of the arm, various size attachments and handles can be attached. The arm also carries a force sensor that measures the forces applied to the handles. In the static mode, the arm is positioned at a desired height and locked in place. The patient lifts on the handle, and the force sensor registers the lifting force. Since the handle does not move during the lift, the mode is called static. In the dynamic mode, the arm/handle moves in the vertical direction during the lift. A resistance mechanism is used to resist the lifting force applied by the user at the handle. The resisting force is always pulling the arm down, both in the lifting and the lowering motion. The resisting force remains constant throughout the range of motion during lifting. The isoinertial machine can also be used in the static mode. The machine also allows the user to test pushing and pulling loads in static mode only.

5 Claims, 8 Drawing Sheets

ISOINERTIAL LIFTING DEVICE

This application is a continuation-in-part of Ser. No. 07/160,758, filed Feb. 26, 1988, now U.S. Pat. No. 4,972,711.

STATEMENT OF THE INVENTION

The present invention is directed to a device for physical therapy, exercise and evaluation in either the static or dynamic mode. More particularly, the present invention provides both a controlled, measured, lift function against a variable and adjustable mass in the dynamic mode and measures applied static force in either the vertical or horizontal direction.

BACKGROUND OF THE INVENTION

In the field of rehabilitative therapy, as well as physical conditioning, exercise and training generally, various devices are known and used both for measuring force applied by an individual and for providing resistive force to facilitate exercise and therapy. These devices usually can function in either the dynamic or static modes but not both modes. Such devices generally are limited to very specific forms and amounts of applied force and generally have not provided both a variable, controlled dynamic resistance and a static mode for measuring applied force.

Our co-pending application Ser. No. 07/160,758, which is incorporated herein by reference, describes a device for use in rehabilitation testing and therapy as well as physical conditioning generally which measures isometrically force applied to the device from any of several directions, such as lifting, pulling or pushing.

U.S. Pat. No. 4,882,677 to Curran describes a combination disability analysis computer system and isometric strength testing device which includes means to calculate anthropometric and joint compression data and which compares actual and expected force.

U.S. Pat. No. 4,235,439 to DeDonno describes a friction exercise device utilizing a system of pulleys, brakes and hydraulic cylinders.

U.S. Pat. No. 373,942 to Page describes a coin-operated, strength testing machine in which a force is exerted against a simple system of cables and a rotary mechanical gauge.

U.S. Pat. No. 3,929,331 to Beeding describes an exercise device in which cable is wound around a pulley whose turning is opposed by springs.

U.S. Pat. No. 4,728,102 to Pauls describes a frictional resistance indicator in which force is applied and measured through a system of cables.

U.S. Pat. No. 3,589,193 to Thornton describes an electric ergometer for imposing work loads which includes a torque motor with controllable feed back loops for imposing variable resistance in response to applied force.

U.S. Pat. No. 3,397,884 to Blasi describes an isometric testing apparatus which uses spring scales to measure the force.

U.S. Pat. No. 3,550,449 to Henson describes a device based on sliding frictional resistance between a rope and a shaft.

U.S. Pat. No. 4,082,267 to Flavell describes a device which is specifically isokinetic (speed regulating).

U.S. Pat. No. 4,592,545 to Sagedahl describes a device which is an attachment for use on an isokinetic machine.

U.S. Pat. No. 4,355,635 to Heilbrun describes a device which is based on the specific design of an exercise apparatus which is motor driven by a variable speed motor and provides therapeutic manipulation for the disabled.

U.S. Pat. No. 3,851,874 to Wilkin describes a device for dynamic exercise whose main purpose is to provide vibration because it utilizes a square pulley. All claims are based on a "non-circular" pulley which is not isometric.

U.S. Pat. No. 4,678,184 to Neiger describes a device which is motor operated for concentric and eccentric exercise and is speed controlled (isokinetic).

U.S. Pat. No. 4,565,368 to Boettcher describes a device which is an attachment for isolating back motion on an isokinetic device and directly restrains the patient above and below the waist and is completely isokinetic (speed controlled).

As noted, however, the devices of the prior art have not generally provided a versatile device for both therapy, exercise and evaluation which has the capacity to function in both isometric and isoinertial modes, and which, in particular provides a lifting function in either mode.

It is accordingly, an object of the present invention to provide an isoinertial device which can function in both the static or dynamic modes to provide isometric evaluation of applied force and controlled, adjustable dynamic resistance in the isoinertial mode to applied lift force.

It is a further object of the present invention to provide an isoinertial lift device having an isometric function which permits computerized evaluation of user performance and which is provided with an automatic clutch mechanism to prevent sudden release of weights.

SUMMARY OF THE INVENTION

In accordance with the present invention a device is provided which functions in both the dynamic and static modes to provide exercise, rehabilitative therapy and evaluation of user applied force. Essentially, the device of the invention comprises a horizontal arm mounted for vertical movement on an upright standard. Mounted on the distal end of the horizontal arm is a load sensor and handle to which is attached a flexible cable. The flexible cable is attached through a system of pulleys to a rotatable drive pulley mounted on a shaft such that vertical movement of the horizontal arm causes rotation of the shaft. A second cable connects a set of weights through a system of pulleys to a weight pulley also mounted on the rotatable shaft. The weight pulley is mounted to turn independently of the shaft; however a clutch mechanism is provided to engage or disengage the drive and weight pulleys from one another so that they either turn together with the shafts or independently of each other. Thus, force exerted against the horizontal arm in the vertical (lift) direction is transmitted and applied against the weight stack when the drive and weight pulleys are engaged. When the drive and weight pulleys are disengaged, the drive pulley and shaft are free to turn independently of the weight stack resistance in response to movement of the horizontal arm. Provision is also made for locking the horizontal arm in position on the upright standard so that no vertical movement of the arm can occur, and applied force is exerted through the handle isometrically directly on the load sensor attached to the end of the arm.

The invention will, however, be more fully understood and appreciated by having reference to the drawings which illustrate in detail a preferred embodiment thereof:

DETAILED DESCRIPTION OF THE INVENTION

Figure 1:
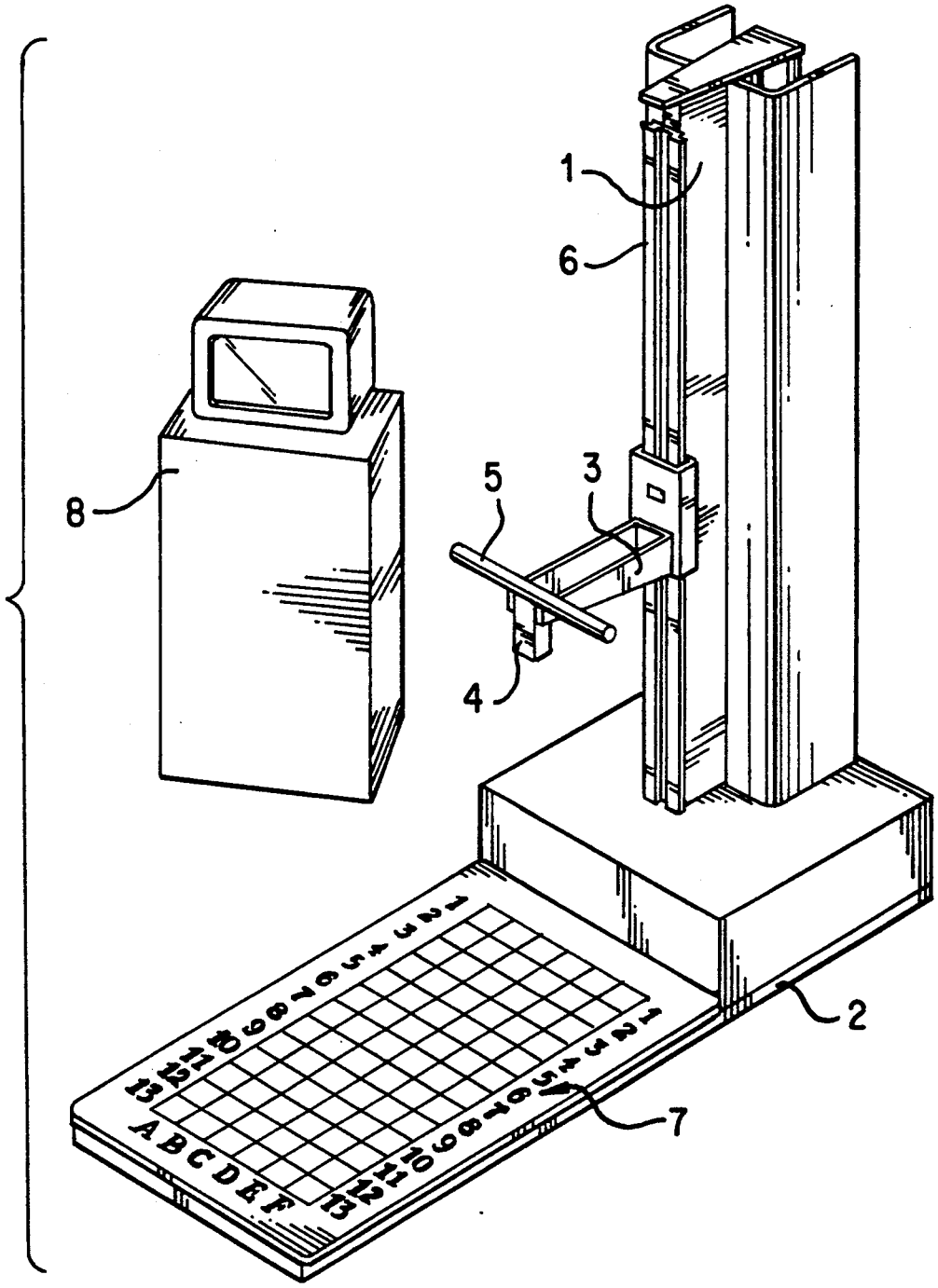
FIG. 1 is a front perspective view of the device of the invention.
Figure 2:
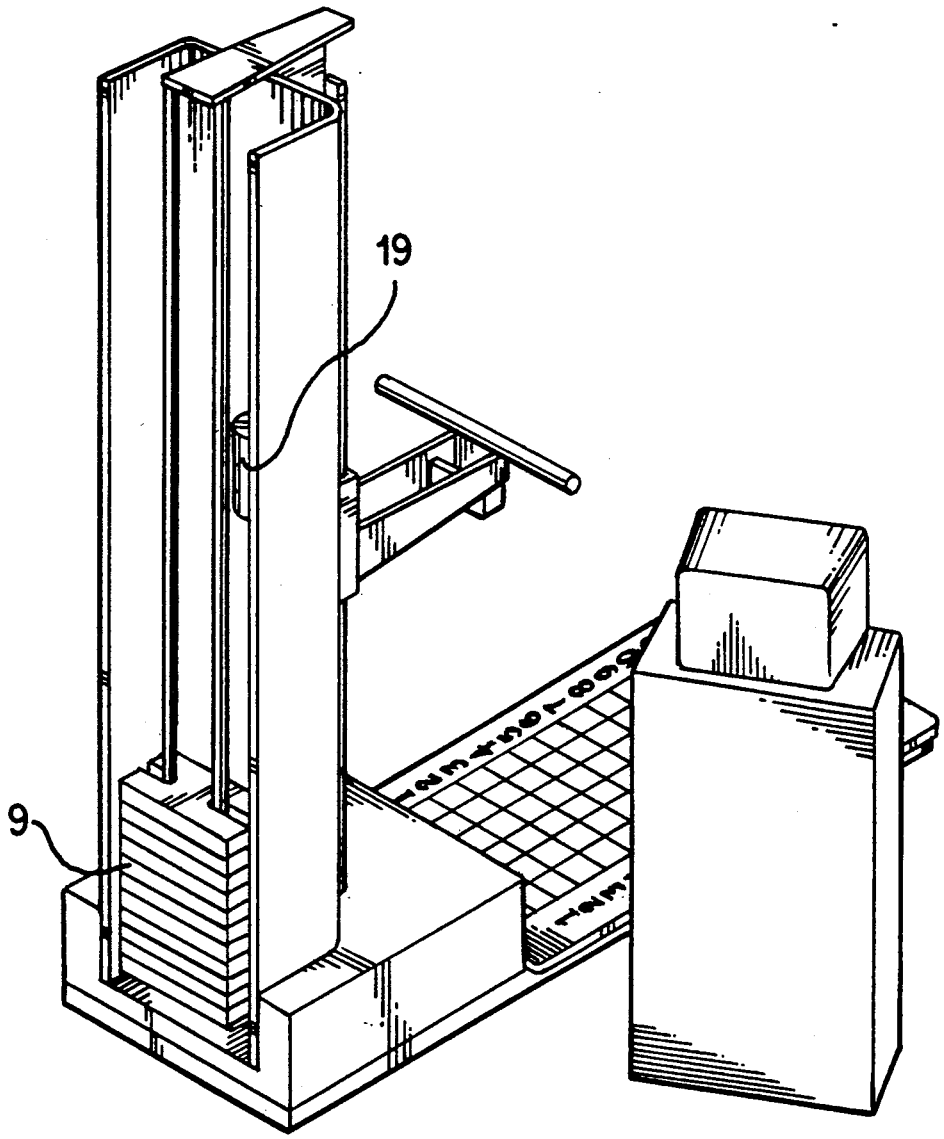
FIG. 2 is a rear perspective view of the device of the invention.

Directing attention initially to FIGS. 1 and 2 of the drawings, lift arm (3) is mounted to move up and down on vertical column (1) mounted on base (2) and platform (7). A handle (5), or other implement, is attached to a load sensor (4) mounted on the distal end of the arm (3). A set of linear bearings restricts motion of the arm to the vertical direction on very low friction guide rails (6). In the dynamic mode, resistance is provided by a stack of weights (9). The amount of weight, and therefore the resistance to lifting, is selected by inserting a pin in a bar carrying the weight stack. The connection from the lift arm to the weight stack involves two cable loops, a number of pulleys and a clutch, which are shown in greater detail in FIG. 3 and 4.

There are two closed cable loops in the system, one carrying the lift arm (3) and the other weight stack (9). They engage one another by means of a clutch (43), which can be a spring engaged, electromagnetically disengaged tooth clutch, although other types of clutches can be used also. If the clutch is engaged, lifting force exerted on the lift arm causes the selected weight stack to move up also. By disengaging the clutch, the arm can be moved freely without lifting the weights.

Figure 4:
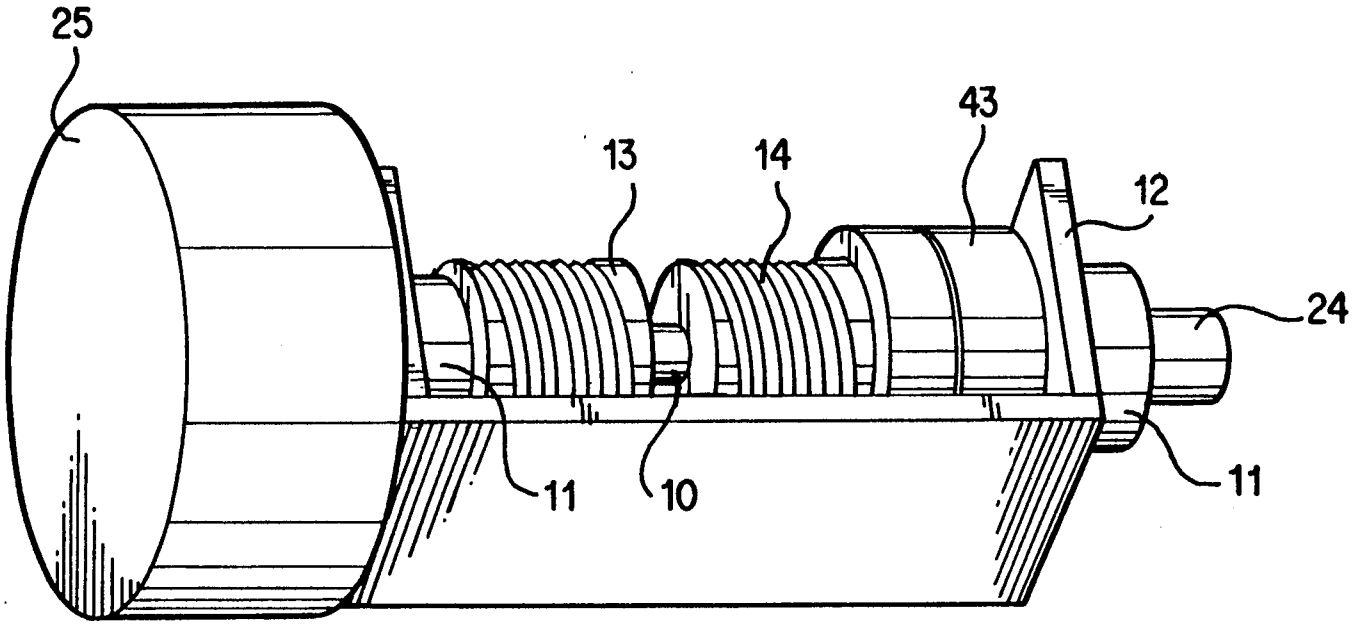
FIG. 4 is a perspective view of the drive mechanism.
Figure 5:
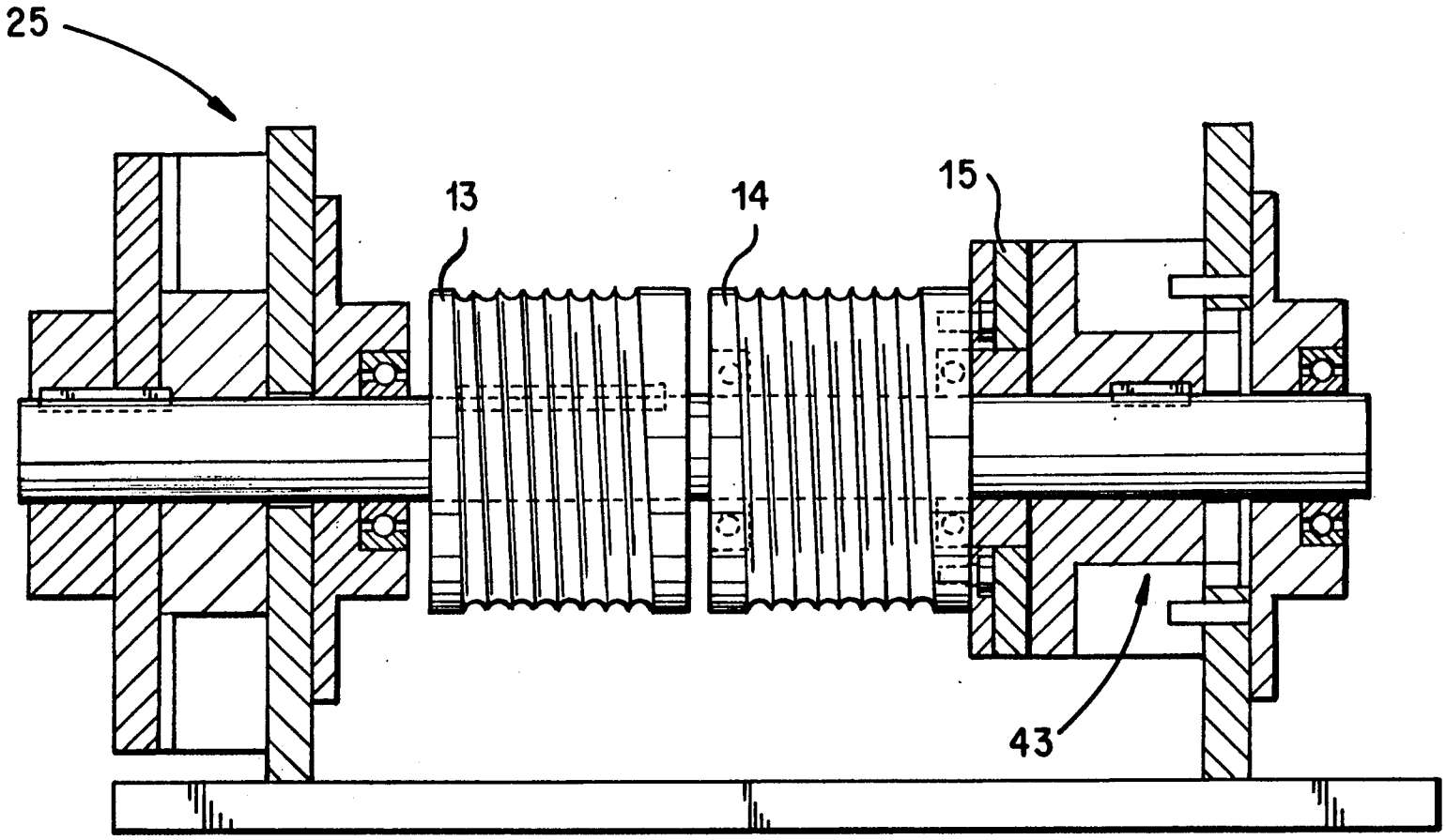
FIG. 5 is a detailed cut-away view of the drive mechanism.

FIGS. 4 and 5 show the drive mechanism of the invention which consists of a shaft (10) mounted between two flanges (12) through radial bearings (11). The shaft carries two pulleys (13 and 14) with helical grooves. The drive pulley (13) is rigidly attached to the shaft through a key (not shown). The weight pulley 14 is mounted to the shaft on bearings, so that if the shaft is rotated, the weight pulley does not move. The weight pulley is rigidly connected to the output flange (15) of the clutch. The input flange of the clutch is attached to the shaft through a key (not shown). The clutch is disengaged when its input and the output flanges are free from each other. With the clutch in disengaged state, if the drive pulley (13) is rotated, the shaft (10) rotates, causing the input flange 27 of the clutch to rotate, but the weight pulley (14) does not rotate. If the clutch is engaged, its input flange is engaged with the output flange and hence to the weight pulley, so if the drive pulley is rotated, the weight pulley rotates too.

The Drive Cable Loop (16) is connected to the lift arm (3). The cable passes over two idler pulleys (17 and 18) and carries a counterweight (19) to balance the weight of the lift arm. The cable then passes over the idler pulley and wraps around the Drive Pulley (13) with helical grooves for guiding the cable and preventing it from wrapping over itself for a few turns and returns to the lift arm (3). When the lift arm is moved, the cable (16) moves with it, rotating the drive pulley and the shaft. Tension in the cable prevents it from slipping over the Drive Pulley.

Figure 3:
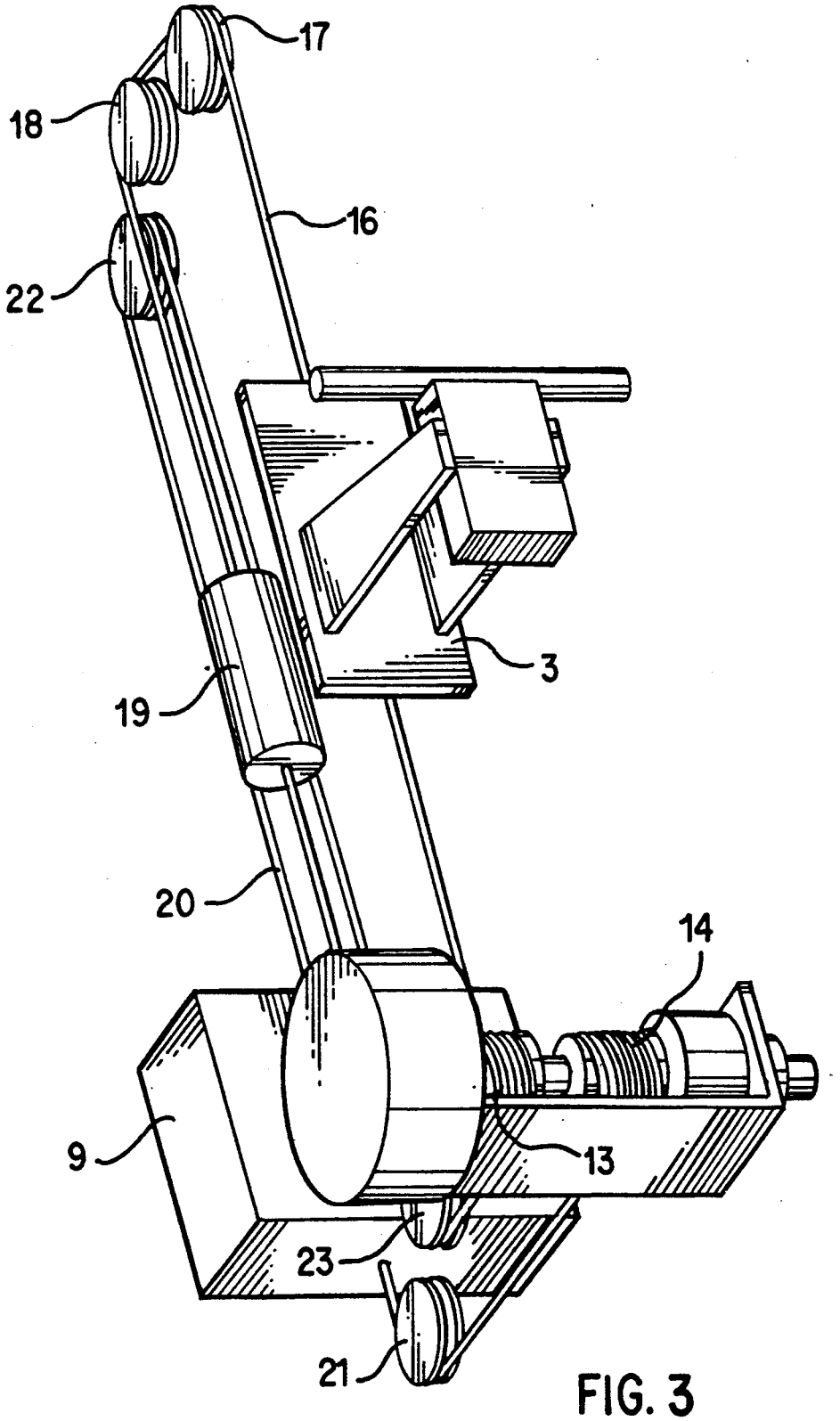
FIG. 3 illustrates the drive/weight system of the invention.
Figure 8:
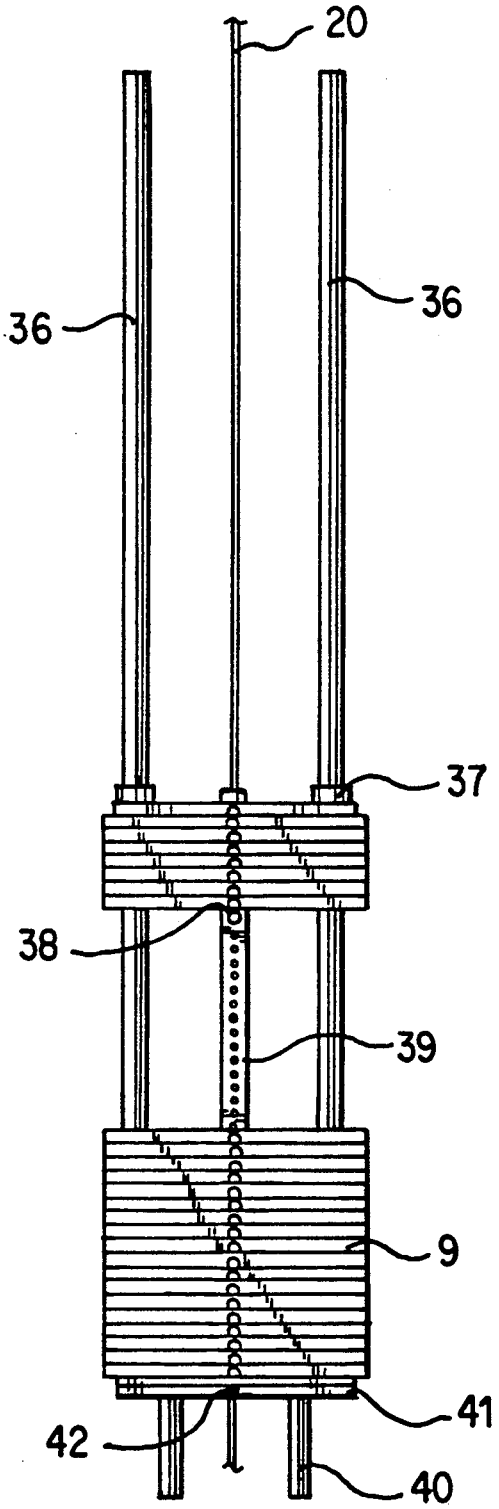
FIG. 8 illustrates details of the weight stack.

As shown in FIGS. 3 and 8, the Weight Cable Loop (20) has a cable end attached to the weight bar (39). After going over the idler pulley (21) it wraps around the Weight Pulley (14). After going over direction changing idler pulleys (22 and 23), it terminates in the the weight bar 39. The weight stack is attached to the bar 39 using a pin 38. If the Weight Pulley (14) is rotated, the weight stack (9) moves up vertically.

If clutch (43) is disengaged, and the lift arm (3) is pulled up, the Drive Pulley (13) rotates, rotating the shaft (10) and the input flange of the clutch. Since the input and the output flanges of the clutch are free from each other, neither the output flange nor the Weight Pulley rotate, keeping the Weight Cable and the Weight stack stationary. Thus, the lift arm moves free without resistance as it remains disconnected from the weight stack. Engaging the clutch, indirectly engages the Weight Pulley (14) to the shaft (10), and lifting the arm causes the Drive Pulley, the shaft and the Weight Pulley to rotate, hence lifting the weight stack. The raising of the weight stack causes resistance to lift at the lift arm.

To initiate a lift exercise, appropriate resistance is selected by inserting the pin at the correct location in the weight stack. The lift arm (3) is now moved to the starting height. To do this, the clutch is disengaged, disengaging the lift arm from the weight stack, so the arm can be moved to the starting height while leaving the weight stack stationary at its bottom most position. Now, the clutch is engaged, engaging the lift arm with the weight stack. If the arm is now lifted, the weight stack moves up too, providing resistance to the lifting due to its weight.

The drive mechanism also contains a position sensor (24) connected axially to the shaft. It measures the position of the lift arm. The position data is sent to the computer (8), where it is used to calculate the movement parameters such as velocity, acceleration, etc.

The drive mechanism also has a brake (25) connected to the shaft (10). The brake is activated under the following conditions:

1) When very high speeds of movement are detected, indicating a free falling weight stack, it implies that the user cannot apply enough resistance to control the weights, and an emergency condition is assumed. The brake is applied, stopping the motion of the lift arm and the weight stack.

2) One mode of exercise involves lifting the weights and then letting the system lower them back to the starting position. This is accomplished by monitoring the speed of the falling weights and applying the brake partially to keep the weight stack lowering speed within limits.

3) When lifting is to be done in the Static/Isometric mode, after moving the lift arm to the desired lifting height, the brake is fully applied, locking the shaft, and hence the lift arm in place. This prevents any movement of the lift arm when lifting force is applied to the lift arm.

Figure 6:
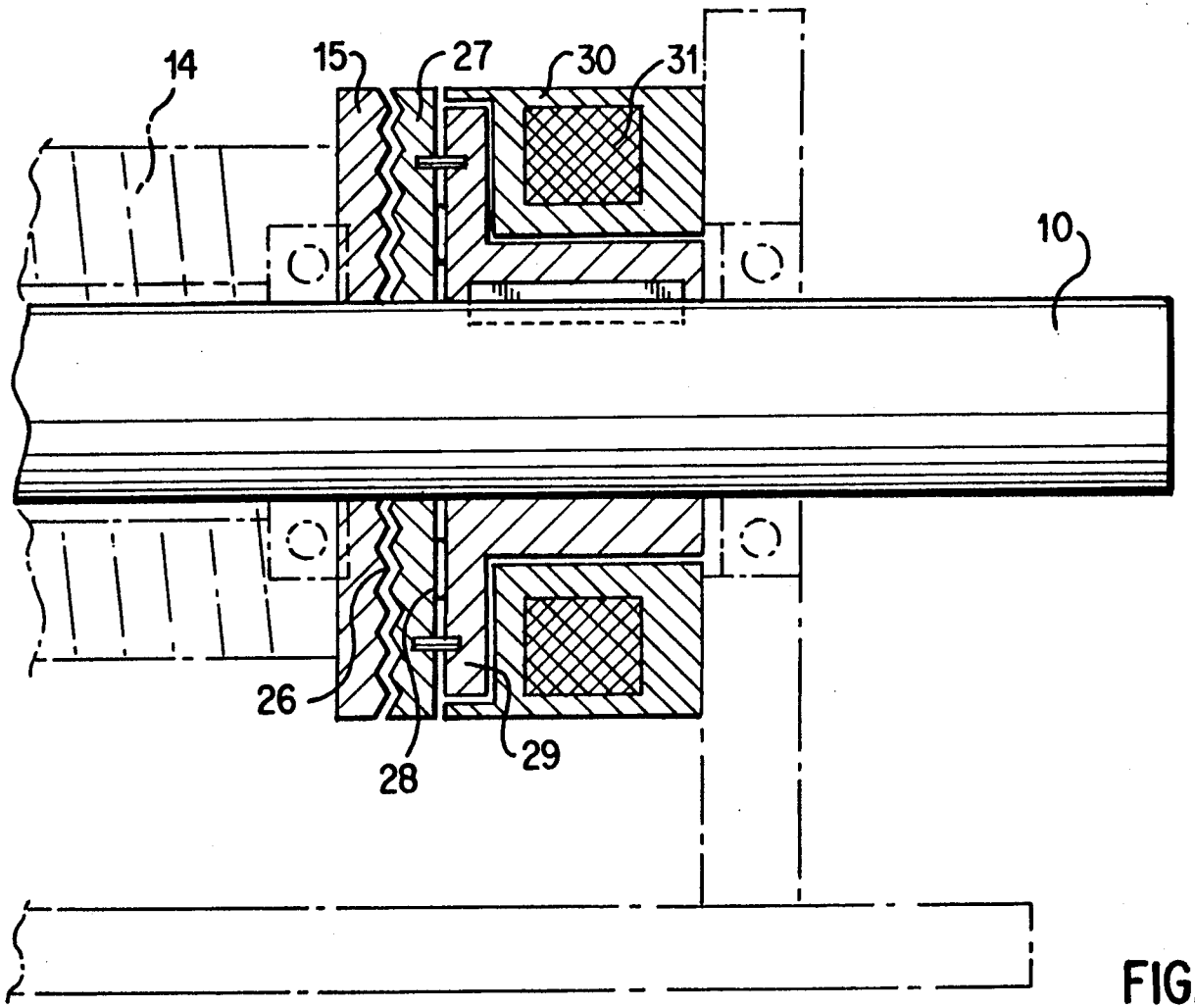
FIG. 6 illustrates details of the clutch mechanism.

As shown in FIG. 6, the output flange (15) is attached to the weight pulley (14). The flange has teeth (26) on it which mesh with the teeth on the armature (27). The armature is normally pushed by a spring (28) against the output flange. The armature is connected to the clutch rotor (29), and rotates with it, The rotor rotates inside the magnet body (30) that has coils (31) imbedded in it. The rotor is attached to the shaft (10) through a key. When the clutch is powered on, the electromagnetic force attracts the armature towards the magnet body, overcoming the spring and disengaging the armature teeth from the output flange. The output flange, hence the weight pulley no longer remain connected to the shaft, and the shaft and the load pulley rotate freely without rotating the weight pulley.

When the clutch is turned off, there is no force to overcome the spring, so the spring flexes, pushing the armature against the output flange engaging their teeth. If the shaft and the load pulley are rotated, the rotor, the armature, the output flange and hence the weight pulley rotate, causing engagement of the load and the weight pulley.

Figure 7:
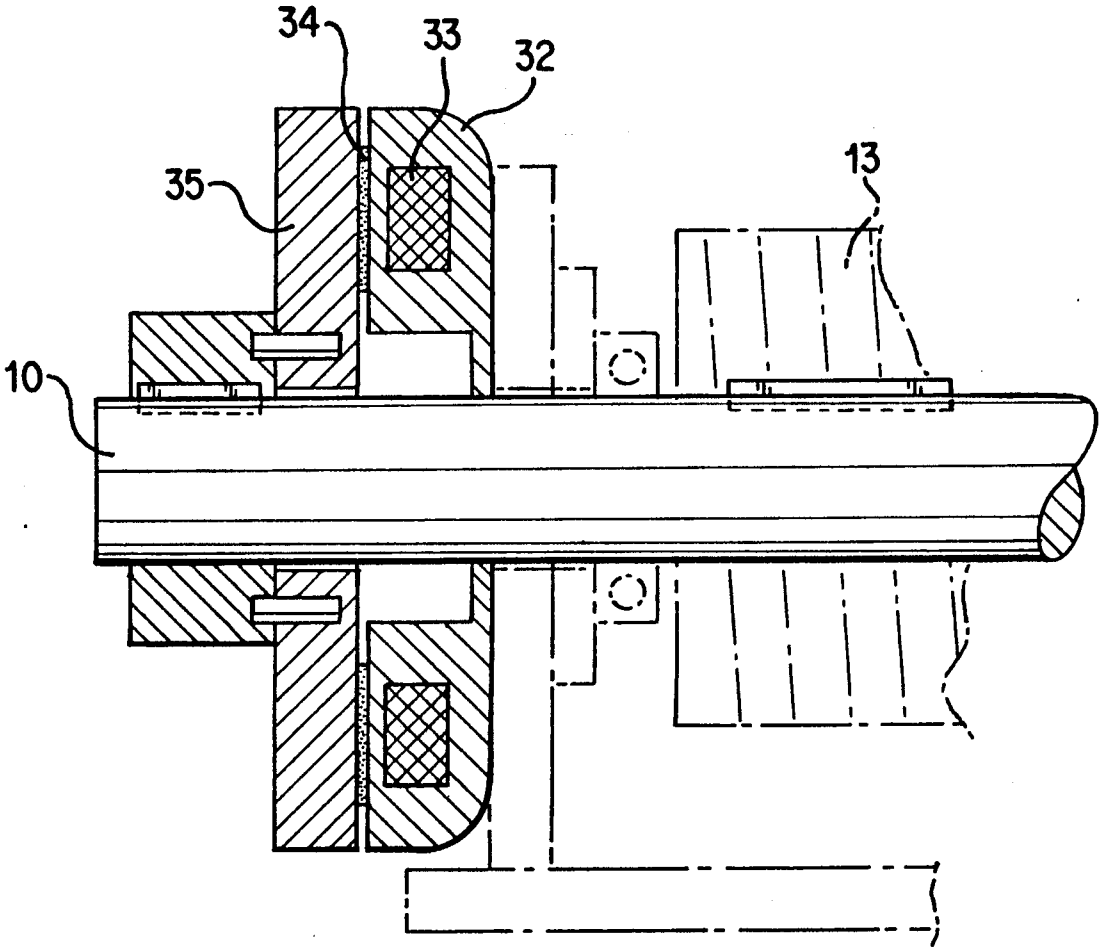
FIG. 7 illustrates details of the brake mechanism.

As shown in FIG. 7, the brake (25) consists of a magnet body mounted on a support flange. The magnet body (32) has magnetic coils (33) imbedded in it, and a friction material facing (34). An armature (35) is attached to the shaft (10) through a key and is free to shift laterally. The brake is used in the isometric mode or to slow the weight stack during an exercise. In the isometric mode, the shaft (hence the load pulley and the arm) is locked into position by applying full brake force to the shaft. When the brake is energized, the armature is pulled against the friction facing the magnet body. To apply full brake, maximum current is applied to the brake, generating a high electromagnetic force and the friction force does not allow the armature or the shaft to rotate, keeping the drive pulley (13) hence the arm stationary.

To slow down the weight stack during an exercise or emergency situation, a partial brake is applied. It involves applying only a small amount of current to the brake, creating a low electromagnetic force. The force is not large enough to lock the shaft, but allows it to rotate against the partial braking force, hence the arm and the weight stack.

A number of weights make up the stack (9). The weight cable loop (20) passes through a hole in the middle of each weight. A bar (39) makes a part of the weight cable loop by having ends of the weight cable connected to the bar ends. The weight lift bar as shown in FIG. 8, has lateral holes in it. A weight engagement pin (38) is used to engage the weight stack to the weight lift bar by inserting the pin into a hole in the bar under the appropriate weight. For example, if the user selects to lift 70 lbs., the pin is inserted into the weight lift bar under the seventh weight assuming each weight to be 10 pounds.

The weight stack is guided to travel into a vertical direction by two guide bars (36). A guide plate on top of the stack has two bushings (37) to accomplish smooth sliding on the guide bars. The weight guide plate is rigidly attached to the weight lift bar. The weight stack sits on a weight plate 41, which is rigidly attached to the machine base through supports (42), so it does not move. The base plate has a hole in it, called the isometric locking hole. It is used to lock the weight cable into position by inserting the weight pin into the weight lift bar through the isometric locking hole (42).

In dynamic lift, the weight pin is inserted into the weight lift bar under the appropriate weight. When the lift arm is moved up, the drive pulley rotates, rotating the weight pulley through the engaged clutch. Since the weight cable is wrapped around the weight pulley, it moves in such a way so that the weight lift bar moves vertically up. With the bar, moves the weight pin, lifting the selected weights above it. The user ends up applying sufficient force to lift these weights. While lowering the arm, the user resists the gravitational pull of these weights, thus lifting and lowering of the weights is accomplished.

The isometric lift involves locking the lift arm rigidly in place while the user applies a vertical force to it. It is accomplished by applying full brake and locking the shaft. If there is a power failure during the lift, the brake may lose its holding force, causing the lift arm to suddenly move under the user applied force, possibly causing injury to the user. To prevent this from happening, for redundant safety, the weight pin is also inserted into the weight lift bar through the isometric hole. Since the base plate is rigidly attached to the machine base the weight lift bar becomes un-movable, locking the weight cable in place. In case of a power failure when the brake loses its holding power, since the weight cable is locked, the weight pulley and hence the shaft and the drive pulley are locked into position too, preventing the lift arm from moving.

What is claimed is:

1. A device for exercise and evaluating of both applied dynamic and static force which comprises an upright standard having a horizontal arm mounted thereon for vertical movement on said standard in a dynamic mode, said arm having a force sensor means for registering applied force attached on the distal end thereof and handle means attached to said force sensor means for applying force to said arm in either the horizontal or vertical direction; said arm being connected to first elongated, flexible connector means which is attached to a rotatable drive pulley mounted on a shaft such that said vertical movement of said arm causes rotation of said shaft; second flexible elongated connector means connecting a weight means to a rotatable weight pulley also mounted on said shaft such that rotation of said weight pulley causes vertical displacement of said weight means; clutch means mounted on said shaft for causing engagement/disengagement of said drive pulley and weight pulley to cause the respective pulleys to turn together or independently of one another; said horizontal arm being provided with means for locking it in position on said standard in the static mode to prevent said vertical movement in response to force applied thereto; and said force sensor means being connected to means for evaluating and recording applied force in both the static and dynamic modes.

2. The device of claim 1 in which a counterweight means is attached on said first connector means to oppose vertical movement of said arm.

3. The device of claim 1 wherein a brake means is provided on said shaft for opposing rotation thereof.

4. The device of claim 1 wherein each of said first and second flexible connectors are a continuous loop, the ends of which connect respectively to said arm and said weight means.

5. The device of claim 1 wherein said connector means are cables.

* * * * *